US007254920B2

(12) United States Patent
Steele

(10) Patent No.: US 7,254,920 B2
(45) Date of Patent: Aug. 14, 2007

(54) TILE-LEVELING DEVICE

(76) Inventor: Roland Steele, 7124 Wilburdale Dr., Annandale, VA (US) 22003

( * ) Notice: Subject to any disclaimer, the term of this patent is extended or adjusted under 35 U.S.C. 154(b) by 492 days.

(21) Appl. No.: 10/817,943

(22) Filed: Apr. 6, 2004

(65) Prior Publication Data

US 2004/0206027 A1 Oct. 21, 2004

Related U.S. Application Data

(60) Provisional application No. 60/463,690, filed on Apr. 18, 2003.

(51) Int. Cl.
*E04G 21/04* (2006.01)
*E04G 21/26* (2006.01)

(52) U.S. Cl. ..... 52/127.2; 52/127.3; 52/384; 33/389; 33/464; 33/518; 33/521; 33/526; 33/371; 33/410

(58) Field of Classification Search ..... 52/127.2, 52/127.3, 384, 385, 747.11, 747.12, 749.11; 33/526, 527, 482, 456, 465, 562, 473, 419, 33/809, 389, 371, 410, 464, 518, 521
See application file for complete search history.

(56) References Cited

U.S. PATENT DOCUMENTS 1,941,404 A * 12/1933 Lansing ..... 33/410
2,576,983 A * 12/1951 Walker ..... 40/618
2,770,043 A * 11/1956 Kwiecinski ..... 33/452
3,744,141 A * 7/1973 Strickland, Sr. ..... 33/526
4,516,373 A * 5/1985 Osawa ..... 52/387
4,583,343 A * 4/1986 Camp ..... 52/749.11
4,860,518 A * 8/1989 Kingham ..... 52/148
5,263,260 A 11/1993 Smith
5,398,423 A 3/1995 Smith
5,692,311 A * 12/1997 Paquin ..... 33/647
6,101,730 A * 8/2000 Marino ..... 33/526
6,189,227 B1 * 2/2001 Siegfried ..... 33/649
6,367,227 B1 4/2002 Veyna
6,412,185 B1 * 7/2002 Mills et al. ..... 33/526
7,070,667 B1 * 7/2006 Kirby ..... 156/71

* cited by examiner

*Primary Examiner*—Robert Canfield
*Assistant Examiner*—Yvonne M. Horton
(74) *Attorney, Agent, or Firm*—Richard C. Litman

(57) ABSTRACT

A device for setting and leveling tile is provided that comprises an elongated straight edge. The straight edge includes a horizontal tile support flange and a vertical flange. A support leg is adjustably attached to the vertical flange adjacent each end of the straight edge and a bubble level is centered on the vertical flange between the support legs. The thickness of the horizontal support flange is sized so that after all the courses of tile are laid and the straight edge is removed, only a layer of grout is required to complete the installation. If the floor is not level, the support legs are adjusted to center the bubble in the level prior to laying the tiles. When leveling tile around a bathtub, an adjustable brace is affixed onto each of the support legs. Each brace includes and adjustment slot therethrough and a rubber boot secured on one end for engaging the bottom of the tub for supporting the straight edge on the edge of the tub.

15 Claims, 5 Drawing Sheets

TILE-LEVELING DEVICE

CROSS-REFERENCE TO RELATED APPLICATION

This application claims the benefit of U.S. Provisional Patent Application Ser. No. 60/463,690, filed Apr. 18, 2003.

BACKGROUND OF THE INVENTION

1. Field of the Invention

The present invention relates to devices for leveling wall tiles, and more particularly, relates to a floor-mounted device for leveling the first row of wall tile in a shower stall or a bathtub stall.

2. Description of Related Art

Numerous devices have been used to aid in the installation of wall tiles so that the tiles are horizontally leveled and properly aligned. Typically a line is drawn along the wall or in the adhesive securing the tile to the wall and the tiles laid along the line. Another, common way of laying wall tile is to secure a straight edge device to the wall and lay successive rows of tile on the straight edge. After the tiles are set, the straight edge device is removed and tiles are laid over the area previously covered by the straight edge device.

In the U.S. Pat. No. 5,398,423 issued Mar. 21, 1995 to Allen L. Smith, a straight edge apparatus is shown for setting a level, second row of tile in the tub splash above an upper side edge of a tub. To ensure that the rows of tile are level even if the tub is not level, spaced adjustable length legs are clamped onto the straight edge to adjust the ends of the straight edge into alignment with a mark on the wall adjacent the lower end of the tub. The straight edge is held in place on the wall by mastic.

U.S. Pat. No. 5,263,260 issued Nov. 23, 1993 to Lee R. Smith teaches a tile leveler device that permits a tile setter to position the second row of wall tile in a desired pattern and continue to set the desired pattern using long setting cements. The device includes a support member with means for affixing to a wall and for supporting, aligning and centering tile with the support member. Spring biased arms extend out of both ends of the support member to engage the walls of a shower stall to hold the support member in position. Pins are provided in the ends of the arms to provide additional support. The pins penetrate the walls around the tub to securely hold the support member in place. Holes for pushpins are also provided at the ends of the arms so that the support member may be secured to the facing wall only. The ends of the support member are rested upon tiles resting on the top surface of a bathtub. A spirit level is provided on the support member so that the support member can be manipulated so that the second row of tiles are laid level before being secured to the walls.

U.S. Pat. No. 6,367,227 B1 issued Apr. 9, 2002 to Veyna teaches a tile setting rack in the form of a bridge for aiding in setting the first course of tile on a surface above a fireplace. The device includes a pair of horizontal elongated guide bars and a pair of vertical elongated support bars. The guide bars are adjustably connected together to form a single guide bar. A support bar is adjustably attached to each end of the single guide bar. The guide bar includes a leveling bubble to facilitate adjustment of the guide bar relative to the support bars so that the first course of tile placed upon the guide bar is laid level. The adjustable support and guide bars of the device allow the device to be used for setting tile on fireplace openings of various sizes.

None of the above inventions and patents, taken either singly or in combination, is seen to describe the instant invention as claimed.

SUMMARY OF THE INVENTION

The present invention provides a device for setting and leveling tile. The device comprises an elongated straight edge having a horizontal tile support flange and a vertical flange. A support leg is adjustably attached to the vertical flange adjacent each end of the straight edge and a bubble level is centered on the vertical flange between the support legs. The thickness of the horizontal support flange is sized so that after all the courses of tile are laid and the straight edge is removed, only a layer of grout is required to complete the installation. If the floor or tub is not level, the support legs are adjusted to center the bubble in the level prior to laying the tiles.

Accordingly, it is a principal object of the invention to provide a device for setting and leveling the first row of tile in a shower stall.

It is another object of the invention to provide a device for setting and leveling tile for the walls surrounding a bathtub.

It is a further object of the invention to provide a tile setting and leveling device that is foldable into a convenient storage position.

It is a further object of the invention to provide a tile setting and leveling device that permits all the courses of tile to be installed before the device is removed and installation completed by applying a layer of grout.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is a floor based tile-leveling device that permits all the courses of tile to be installed at one time wherein, after removal of the device, the installation is completed with only a layer of grout. The device comprises an elongated straight edge preferably formed of metal such as aluminum. Preferably, the aluminum used is ⅛" stock, the thickness being equal to the width or height of the grout joint that will be placed beneath the first course of tile to complete the job.

Figure 1:
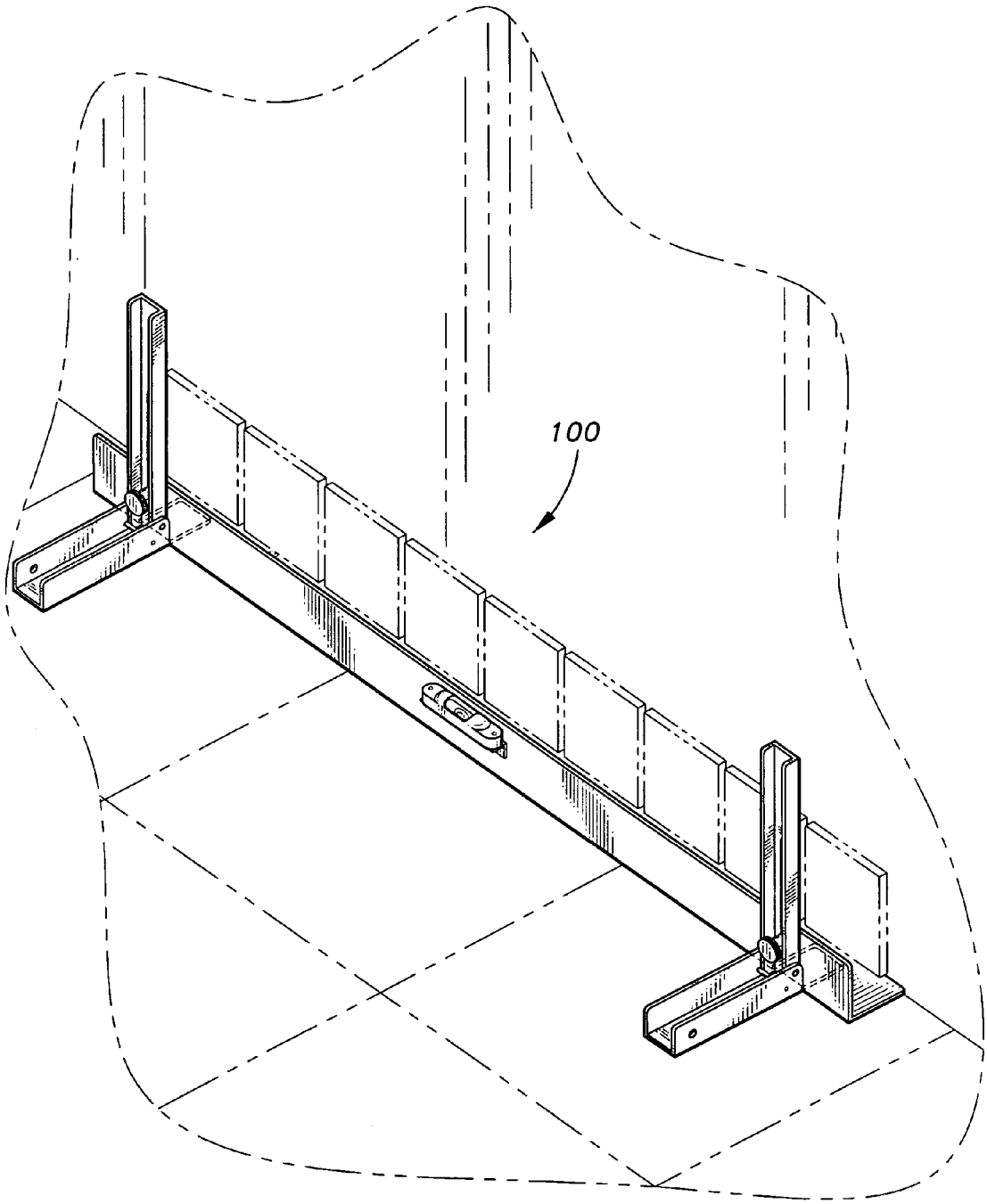
FIG. 1 is an environmental, perspective view of a tile-leveling device according to the present invention.
Figure 2:
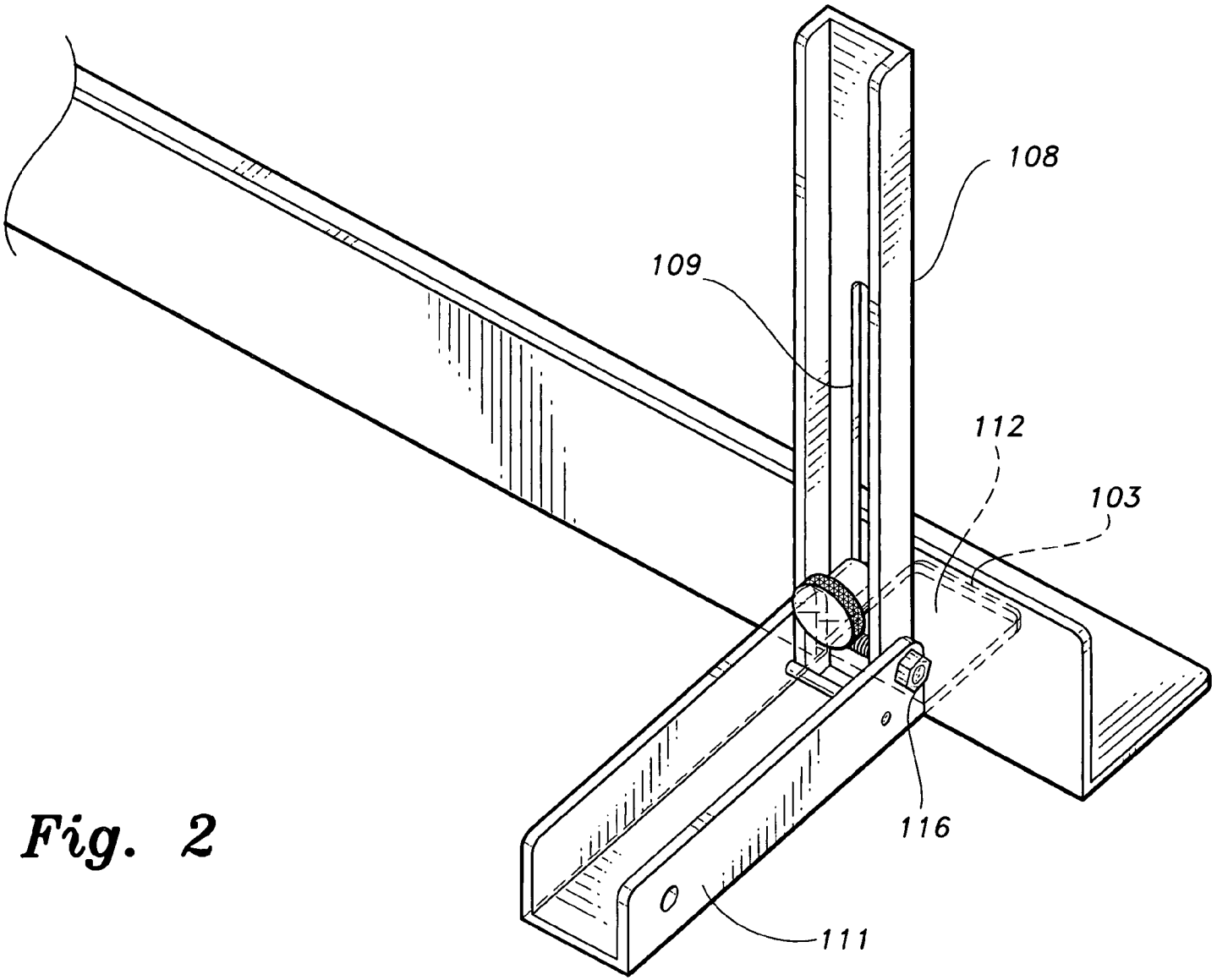
FIG. 2 is an enlarged perspective view of one end of the tile-leveling device.
Figure 3:
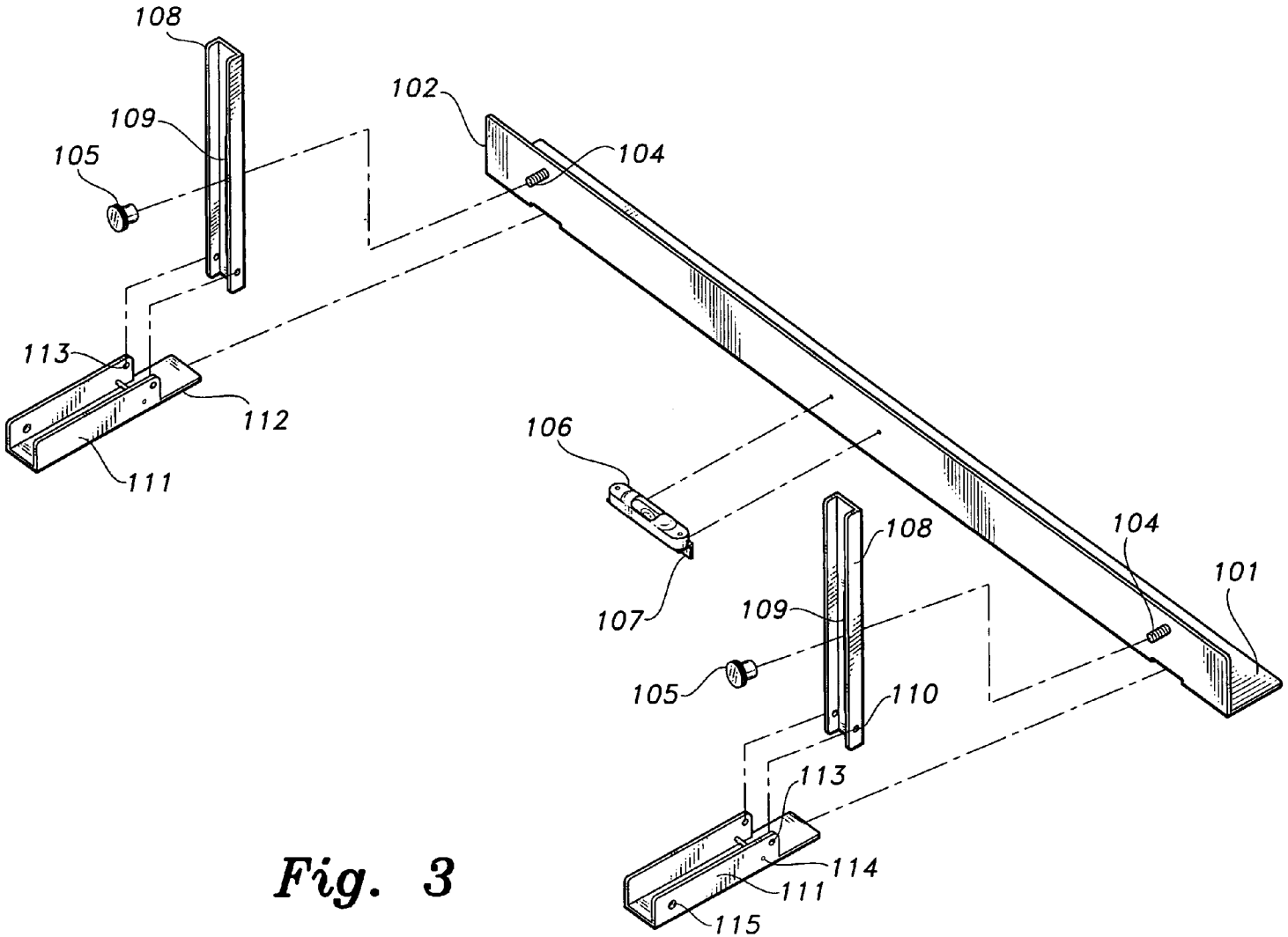
FIG. 3 is an exploded view of the tile-leveling device.

As best seen in FIGS. 2 and 3, the straight edge portion of the device comprises a horizontal tile support flange 101 and a vertical flange 102. To prevent the straight edge portion from tipping over during use, support means is provided in the form of a pair of metal support legs 108 that are U-shaped in cross-section. Each leg 108 includes a longitudinally extending adjustment slot 109 therein for attaching the leg 108 to the vertical flange 102. Studs 104 adjacent each end of the vertical flange 102 pass through the adjustment slot 109 of each leg 108, whereby each leg 108 can be securely and adjustably fastened onto the vertical flange 102 by an internally threaded locking nut 105.

Nut and bolt pivotally attach the lower end of each leg 108 to one end of a metal foot 111. Metal foot 111 is also U-shaped in cross-section but slightly larger in size than the cross-section of the leg 108 such that the lower end of the leg 108 is pivotally received between the vertical flanges of the foot 111 as shown in FIGS. 2 and 5.

The base of the foot 111 includes a flat extension portion 112 that extends beyond the flanges of foot 111. The extension portion 112 of each foot 111 is shaped to be received within an aperture 103 formed adjacent each end of the tile support flange 101. The apertures 103 are centered about the studs 104 such that when the leg 108 is attached to the vertical support flange 102 the extension portion 112 is received within the aperture 103 of flange 101 and lies coplanar with the flange 101. A stop pin 114 is provided in each foot 111 adjacent to the pivotally connected end of the foot 111. Stop pin 114 allows the foot 111 to pivot ninety degrees relative to leg 108 in one direction only.

Figure 4:
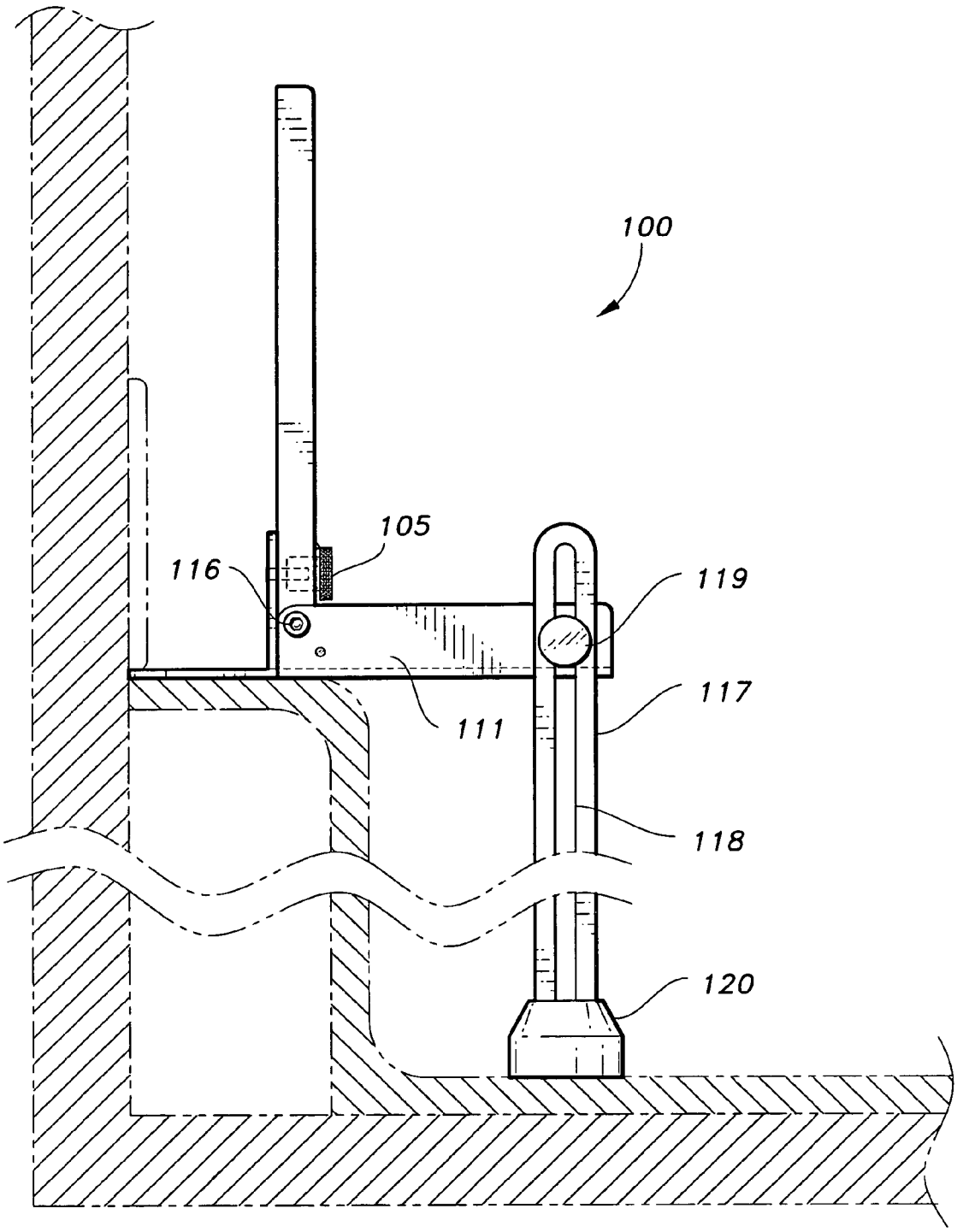
FIG. 4 is a side view of the tile-leveling device mounted on the edge of a bathtub.
Figure 5:
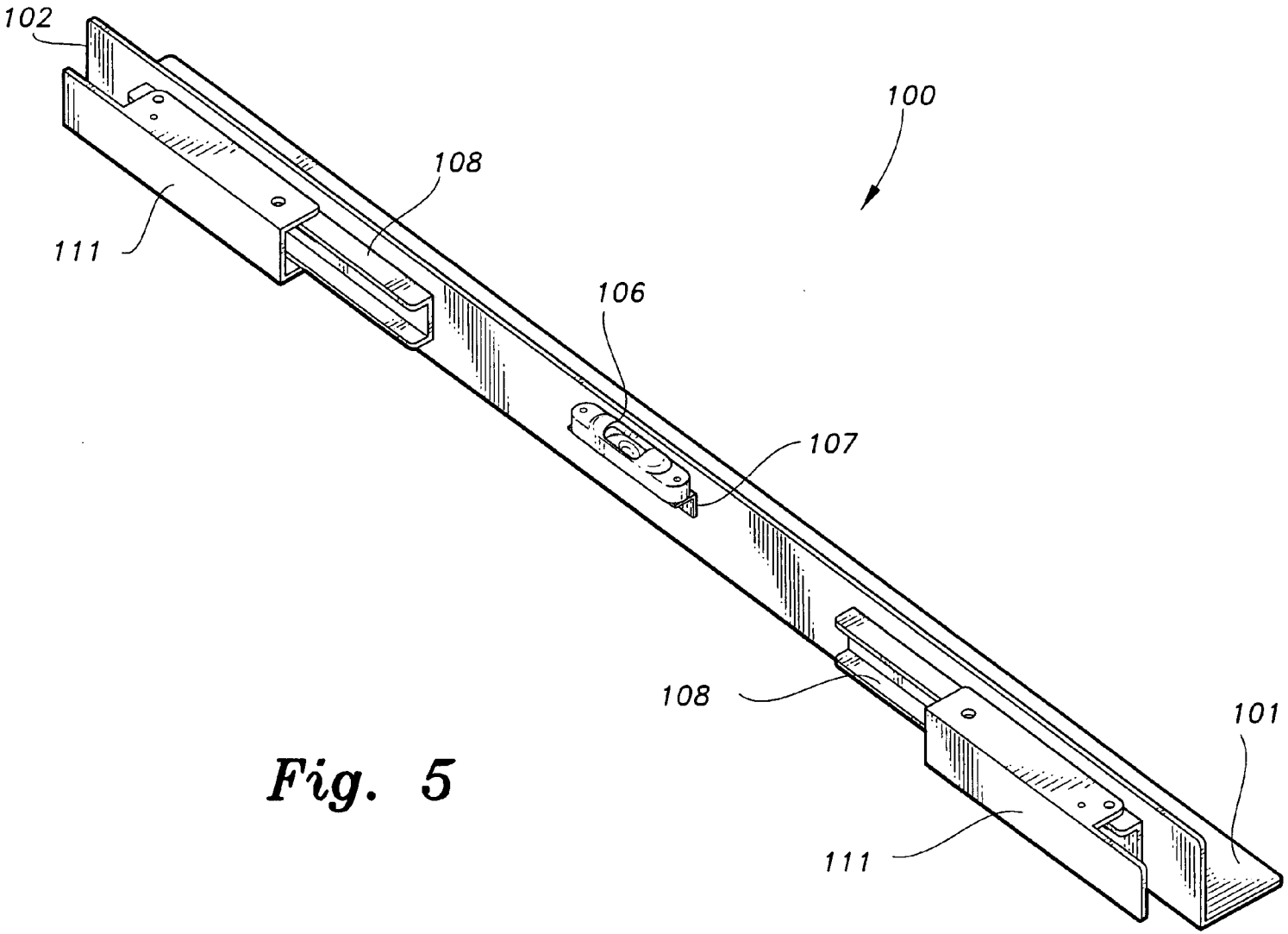
FIG. 5 is a perspective view of the tile-leveling device in a folded storage position.

As best seen in FIG. 5, when nuts 105 are loosened, legs 108 may be rotated into alignment with vertical flange 102 and each foot 111 may be pivoted onto respective legs 108 so that the device can be conveniently carried and stored. A shelf 107 is centered between the ends of the vertical support flange 102 and a bubble level 106 is centered on the shelf. When either the floor of the shower or the edges of the tub where installation is taking place is not level, locking nuts 105 are loosened and legs 108 adjusted to level the device prior to installing the tiles.

Where the width of the edges of the bathtub is less than the length of the support foot 111, additional support means are provided in the form of an adjustable metal support brace. The support brace may alternatively be telescopic. As shown in FIG. 4, support brace 117 is provided with an elongated slot 118 along it's length and a rubber boot or suction cup 120 on it's lower end. A knurled adjustment bolt 119 passes through the slot and is threaded into an aperture 115 on the distal end of support foot 111 to secure the brace to foot 111. Brace 118 is adjustable so that the tile support flange 101 remains level on the edge of bathtubs of various depths. The rubber boot or suction cup 120 helps maintain the device in place by securely supporting the device on the floors of bathtubs.

It is to be understood that the present invention is not limited to the sole embodiment described above, but encompasses any and all embodiments within the scope of the following claims.

I claim:

1. A tile-leveling device comprising:

a straight edge portion, said straight edge portion including an elongated horizontal tile support flange joined to an elongated vertical support flange, wherein said horizontal tile support flange has a thickness equal to a layer of grout;

means for adjustably supporting said straight edge portion on a floor of a shower stall, wherein said means for adjustably supporting said straight edge portion includes:

a stud in said vertical support flange adjacent each end of said vertical support flange;

a foot extension receiving aperture in said tile support flange adjacent each end of said tile support flange, each said aperture being centered about a respective stud on said vertical support flange;

a pair of vertical support leg, each leg having a leg adjustment slot for receiving one of said studs;

a pair of horizontal support feet, each foot having a foot extension and each foot being pivotally attached to a lower end of a support leg adjacent said foot extension; and a pair of internally threaded nuts for adjustably securing said vertical support legs onto the vertical support flange using said studs; and means for leveling said straight edge portion secured to the center of said vertical support flange.

2. The tile-leveling device according to claim 1, wherein said means for leveling said straight edge comprises a bubble level mounted on a shelf central located on said vertical support flange.

3. The tile-leveling device of claim 1 wherein each said vertical support leg is U-haped in cross-ion and includes a pair of elongated flanges attached to the sides of an elongated base, said base including said leg adjustment slot.

4. The tile-leveling device of claim 3, wherein each horizontal support foot is U-shaped in cross-section and further include a stop pin for allowing ninety degrees of pivotal movement of said support foot relative to a respective said support leg such that said support leg is pivotal from an operating position to a storage position.

5. The tile-leveling device of claim 4 wherein said support leg nests within the support foot when the support foot is pivoted into said storage position.

6. The tile-leveling device of claim 5, wherein said means for leveling said straight edge comprises a bubble level mounted on a shelf attached to said vertical support flange.

7. The tile-leveling device of claim 6, wherein said internally threaded nuts are knob-shaped.

8. The tile-leveling device of claim 6, wherein a distal end of each support foot includes a threaded aperture for receiving a knurled bolt.

9. The tile-leveling device of claim 8, further including means for adjustably supporting said device on the edge of a bathtub.

10. The tile-leveling device of claim 9, wherein said means for adjustably supporting the device on the edge of a bathtub comprises a pair of elongated metal braces, each brace having an elongated brace adjustment slot therein, a rubber boot on one end of each brace for engaging the bottom of the bathtub; and a pair of knurled bolt passing through said brace adjustment slots and threadedly received in the threaded apertures on the distal ends of each support foot.

11. The tile-leveling device comprising:

a straight edge portion, said straight edge portion including an elongated horizontal tile support flange joined to an elongated vertical support flange, wherein said horizontal tile support flange has a thickness equal to a layer of grout;

a stud in said vertical support flange adjacent each end of said vertical support flange;

a foot extension receiving aperture in said tile support flange adjacent each end of said tile support flange, each said aperture being centered about a respective stud on said vertical support flange;

a pair of vertical support leg, each leg having a having a leg adjustment slot for receiving one of said studs;

a pair of horizontal support feet, each foot having a foot tension and each foot being attached to a lower end of a support leg adjacent said foot extension for pivotal movement relative thereto; and a pair of internally threaded nuts for adjustably securing said vertical support legs onto the vertical support flange using said studs; and a bubble level centrally located on and attached to said vertical support flange.

12. The tile-leveling device of claim 11, wherein said vertical support leg is U-shaped in cross-section and includes a pair of elongated flanges attached to the sides of an elongated base, said base including said leg adjustment slot.

13. The tile-leveling device of claim 12, wherein each horizontal support foot is U-shaped in cross-section and further include a stop pin for allowing ninety degrees of pivotal movement of said support foot relative to said support leg such that said support leg is pivotal from an operating position to a storage position.

14. The tile-leveling device of claim 13, wherein said support leg nests within the support foot when the support foot is pivoted into said storage position.

15. The tile-leveling device of claim 14, further including a pair of elongated metal braces, each brace having an elongated brace adjustment slot therein, a rubber boot on one end of each brace for engaging the bottom of the bathtub; and a pair of knurled bolt passing through said elongated brace adjustment slots and threadedly received in threaded apertures on the distal ends of each support foot.

* * * * *